United States Patent [19]

Bradstock

[11] 4,126,341

[45] Nov. 21, 1978

[54] MOTOR DRIVEN LOCK ACTUATOR

[75] Inventor: Richard L. Bradstock, Burbank, Calif.

[73] Assignee: Adams Rite Manufacturing Co., Glendale, Calif.

[21] Appl. No.: 823,988

[22] Filed: Aug. 12, 1977

[51] Int. Cl.[2] ..... E05C 3/16

[52] U.S. Cl. ..... 292/201

[58] Field of Search ..... 292/201, 144, 197

[56] References Cited

U.S. PATENT DOCUMENTS

| | | | |
|---|---|---|---|
| 3,321,226 | 5/1967 | DeClaire et al. | 292/201 X |
| 3,884,056 | 5/1975 | East et al. | 292/197 X |

*Primary Examiner*—Richard E. Moore

*Attorney, Agent, or Firm*—Whann & McManigal

[57] ABSTRACT

A self-contained electric power driven bolt actuator unit for installation with a high security door locking mechanism comprising a housing adapted to be mounted on the door in operative association with the lock mechanism, a rotatable actuator shaft being mounted in the housing and connected at one end with a bolt actuating cam, an electric motor connected to drive the actuator shaft through a friction driving connection, a manually operable knob for overriding the actuation of the bolt by the cam independently of the motor, and switching means operable upon predetermined rotation of the actuator shaft in each direction of its rotation to reverse the driving direction of said electric motor and for indicating the operative position of the bolt of the locking mechanism.

15 Claims, 10 Drawing Figures

MOTOR DRIVEN LOCK ACTUATOR

BACKGROUND OF THE INVENTION

The present invention relates generally to the field of locks, and more particularly to an electrically energizable power actuator unit for operating a high security lock bolt of the cam actuated type.

Heretofore, cam actuated locking mechanisms have for the most part been arranged for manual actuation by means of an appropriate key. Locks of this type are generally disclosed, for example, in Eads U.S. Letters Pat. No. 2,989,859, issued Jan. 27, 1961. In the lock mechanism of this patent, provision is made for operation of the bolt by means of a 360° rotatable cam connected with the key cylinder actuator, this cam being connected for operation of a bolt actuating lever, rather than directly operating the bolt which in this case is pivotally mounted for swinging movements between locking and non-locking positions. The actuator of the present invention, however, is not to be considered as being limited to the particular lock structure as disclosed in this patent.

More recently, efforts have been made to provide electric power actuators for locks of the above described high security type, and which would be compatible with and permit their being used in connection with the now available sophisticated electronic lock controlling systems of the type utilizing keyed cards, coded push-button systems, proximity switches, and the like.

Having in mind that electric solenoids have long been successfully used for the actuation of certain types of locks and latches, which in the main required only a relatively low power or relatively small bolt or latch movements; attempts were first made to use a solenoid as the power actuating medium. It was found that the use of solenoids presented operation problems when used with a high security type of lock, such as disclosed in the above mentioned Eads Patent. It was found that the solenoid lacked the necessary controlability, power, and in particular the necessary motion or stroke required for the operation of the high security locking mechanism.

Accordingly, the design was changed to include an electric motor driven mechanism, in lieu of a solenoid operable mechanism. The electric motor drive overcomes the inherent problems of the solenoid, and in the present invention has been utilized in combination with a manually operable override to provide a unique actuating unit which may be mounted on the door frame for actuating a high security locking mechanism of the high security type as described above, and yet an actuating unit which is adapted for operation in connection with the great variety of currently available electronic control systems.

SUMMARY OF THE INVENTION

The present invention is specifically concerned with the provision of a unique motor driven power actuating unit that may be installed in operative association with a cam actuated high security locking mechanism on a door to provide actuation of the locking mechanism by any one of a variety of electronic control systems of the type utilizing keyed cards, coded push-buttons, proximity switches, and the like. In addition, the actuator unit embodies a manually operable knob override actuator. The unit is also susceptible of use in addition and in combination with a normally installed key-controlled actuator.

It is one object of the present invention to provide a unique electric power actuating mechanism which can be mounted as a unit on a swinging door for the selective actuation of a cam actuated door locking bolt to locked and unlocked positions.

A further object is to provide a power actuator of the foregoing type in which the power means has a friction driving connection, and which further includes a manually operable knob for overriding operation of the bolt of the associated locking mechanism, independently of the power means.

Another object is to provide a motor driven actuator for a high security locking mechanism, which includes a rotatable actuator shaft for actuating the bolt of the locking mechanism, and embodies switching means operable upon predetermined rotation of the actuator shaft in each direction of its rotation to reverse the motor driving direction and for indicating the operative position of the bolt of the locking mechanism.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DETAILED DESCRIPTION OF A PREFERRED EMBODIMENT

Figure 1:
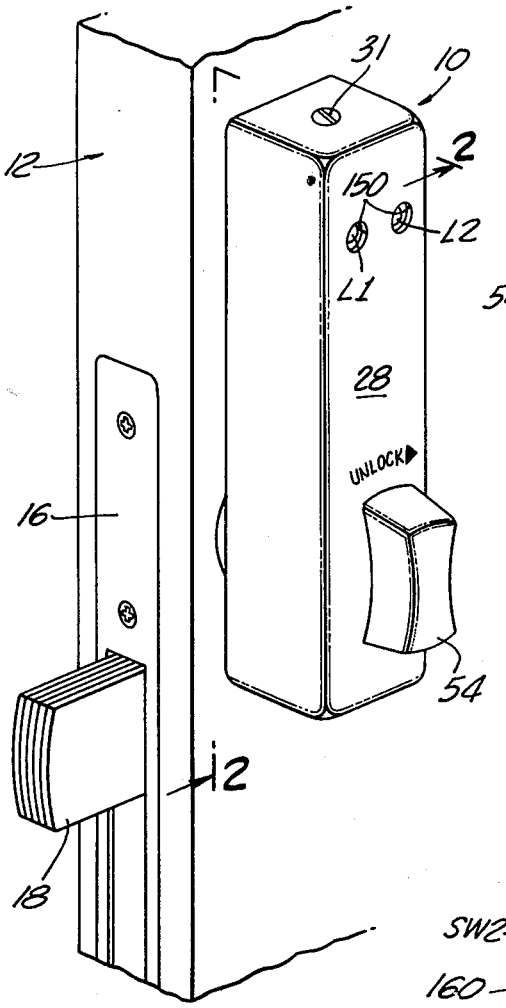
FIG. 1 is a perspective view illustrating the cooperative relationship of an electric actuator unit and conventional high security locking mechanism, according to the present invention.

Referring more specifically to the drawings, for illustrative purposes, there is disclosed in FIG. 1 a lock actuator unit, as generally indicated at 10, which embodies the features of the present invention, the actuator unit being mounted on the face of a swinging door 12 and being operatively connected with an adjacently mounted high security locking mechanism 14 having a face plate 16 mounted in the door edge and through which a bolt member 18 is movable between a locked projecting position and a retracted non-locking position.

Figure 2:
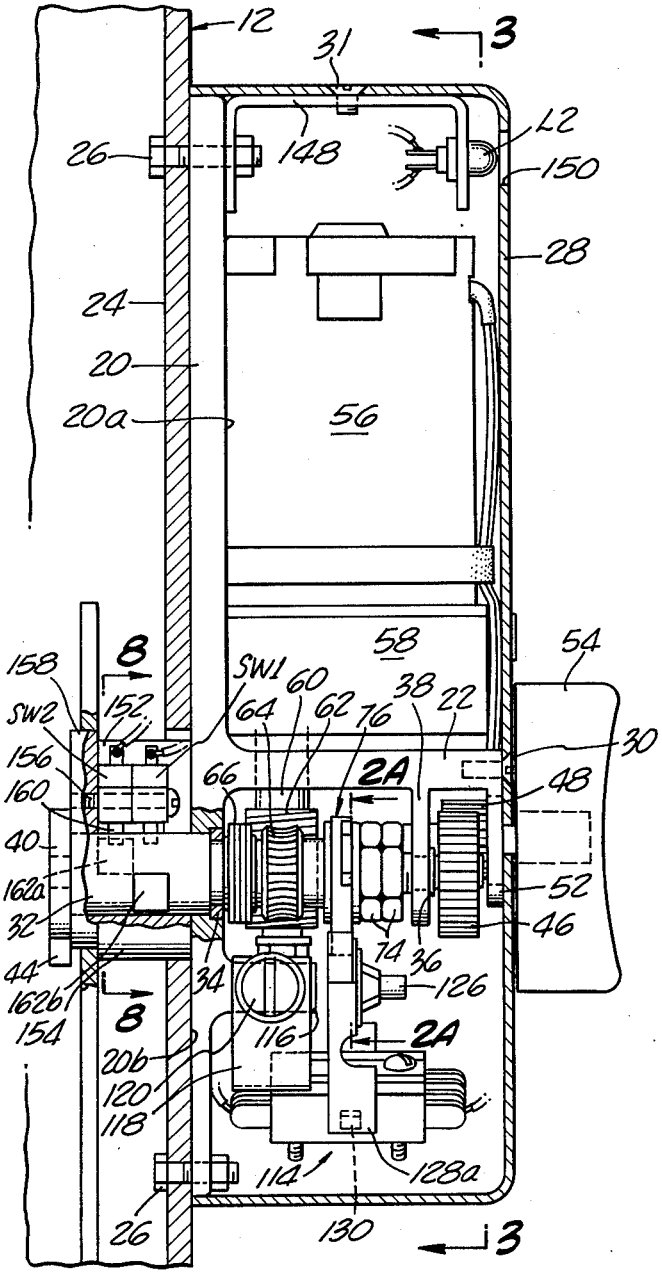
FIG. 2 is a generally vertical section taken substantially on line 2—2 of FIG. 1, showing the internal mechanism of the unit and its operative connection with the locking mechanism of the door.

As best shown in FIG. 2, the lock actuator unit 10 is assembled into a unitary structure upon an elongate base frame 20 which is separated into upper and lower portions 20A and 20B by means of a forwardly extending partition 22. The base frame is adapted to be mounted against a side wall of the door framing, in this case the side wall 24 of an extruded stile, by means of suitable retaining bolts 26. The mechanism of the unit is concealed by a cover member 28 which is removably retained in position by means of a retaining screw 30 which extends through a forward wall of the cover and is threadedly engaged with the outermost edge of the partition 22, and a top screw 31.

Mounted below the partition 22 is an actuator shaft 32 which has its inner end portion rotatably supported in a ring bearing 34 fixedly mounted in the base portion 20B, and an outer end portion which is rotatably supported in a ring bearing 36 which is fixedly supported in a depending lug 38 extending from the partition 22. The inner end of the actuator shaft 32 carries a cam plate 40 which is affixed to the end of the shaft for rotation therewith by a pair of spaced retaining screws 42, the cam plate having a radially extending cam arm 44 which is arranged for operative association with the bolt actuating mechanism of the locking mechanism, as will hereinafter be more fully explained. The outer end of the actuator shaft 32 carries a gear 46 which is arranged to be driven by a driving pinion 48 carried by a stub shaft 50 having its innermost end rotatably supported in the lug 38. The outer end of the shaft 50 extends to the exterior of the cover through a steadying bracket 52 for connection with an externally positioned knob 54 which provides for manual rotation of the actuator shaft 32 in opposite directions to permit manual actuation of the locking mechanism in a manner to place the bolt 18 selectively in its locked and unlocked positions.

Power for actuating the locking mechanism is provided by an electric motor 56 with a coupled gear box 58 having a reduced speed driving shaft 60. The motor is supported on the partition 22 in an upstanding position with the driving shaft 60 extending therethrough and being provided at its lower end portion with a worm 62 having meshed relation with a worm gear 64 that is rotatably supported on the actuator shaft 32.

An important feature of the driving motor connection with the actuator shaft 32 is that the motor does not have a positive driving connection with the shaft, but is connected to drive the shaft through friction clutch means in the form of a series of Belleville washers 66 in which two pair of washers are similarly stacked, and wherein the central washers are positioned with their cupped surfaces in confronting relation so that their peripheries are engaged and will provide friction generating surfaces. The Belleville washers 66 are positioned on the shaft 32 between one end of the hub of the worm gear 64 and abutment shoulder 68 on the shaft 32, abutment washers 70 preferably being interposed on the opposite sides of the Belleville washer assembly. On the opposite side of the worm gear 64, the shaft 32 is provided with a threaded portion 72 having threaded engagement with a pair of adjustable jam nuts 74. Lost motion means, as generally indicated at 76, are mounted on the shaft between the jam nuts and the adjacent end of the hub of the worm gear 64, abutment washers 78 being interposed on the opposite sides of the lost motion means. This lost motion means is utilized for the actuation of auxiliary switching means as will hereinafter be more fully described. With the structure described above, the jam nuts 74 may be adjustably positioned and locked for the purpose of more or less compressing the Belleville washers so as to provide the desired frictional drive between the driving motor and the actuator shaft.

The high security lock mechanism 14 may vary as to details of construction. For purposes of illustration, however, there has been illustrated in FIGS. 6 and 7 a high security locking mechanism of the character disclosed in the prior mentioned Eads U.S. Letters Pat. No. 2,989,859, which is incorporated herein by reference. Briefly, the disclosed locking mechanism comprises a lock casing, as generally indicated by the numeral 80, which is adapted to be secured in an operative position to the inner face of the door frame edge wall or stile edge wall as by means of appropriate mounting screws 82.

Figure 6:
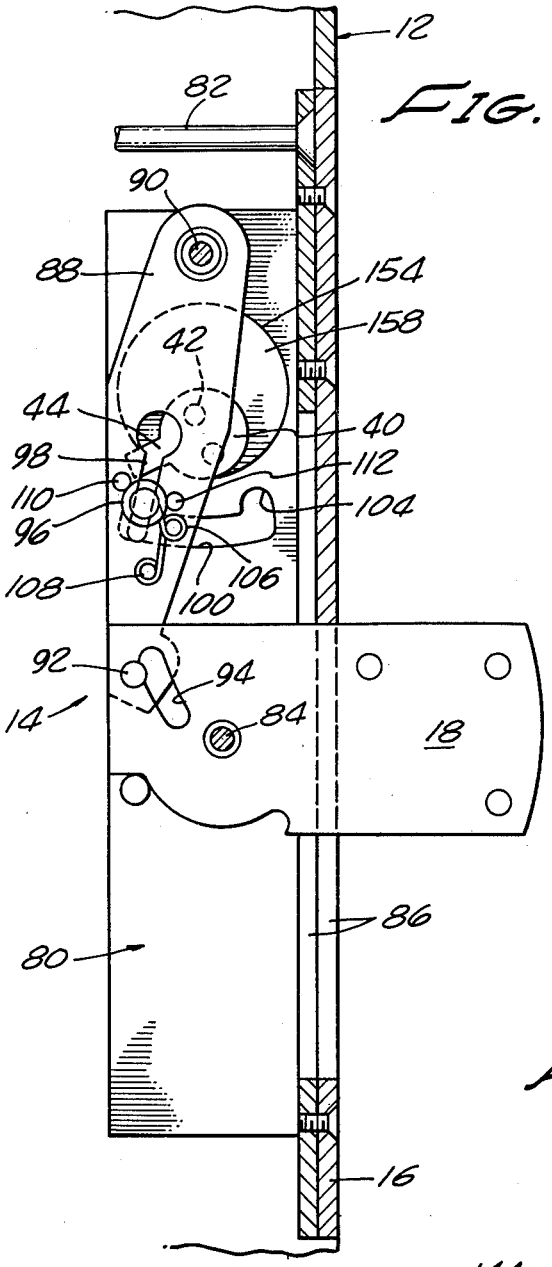
FIGS. 6 and 7 are respectively similar elevational views of an associated high security locking mechanism, the mechanism being respectively shown in locking and unlocking positions.
Figure 7:
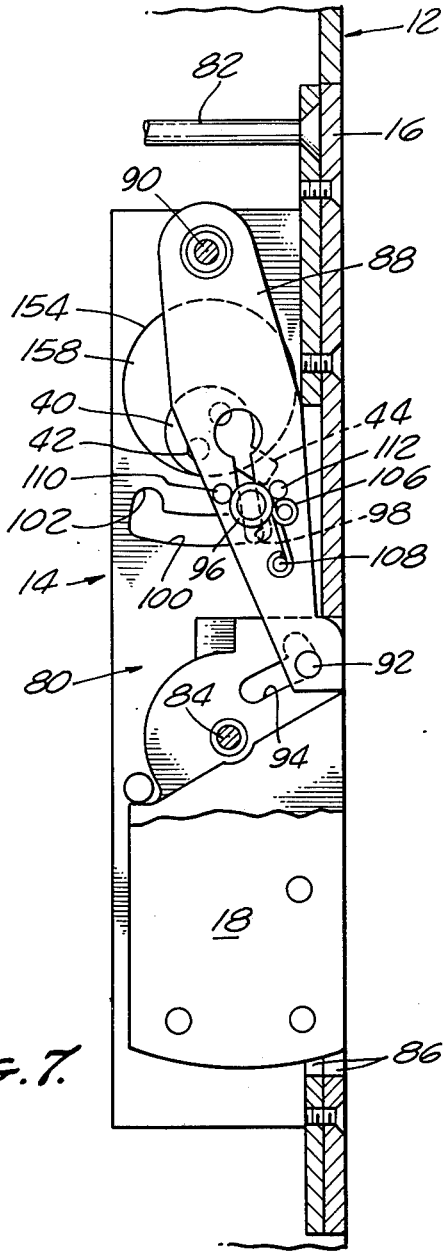

The bolt 18 is supported adjacent its innermost end upon a pivot 84 for swinging movement to an extended locked position projecting through aligned openings 86, as shown in FIG. 6, and a retracted position within the casing as shown in FIG. 7.

The bolt 18 is actuated to its respective operative positions by means of an actuating lever 88 supported on the casing for swinging movements on a pivot 90 at one end, this pivot being vertically positioned with respect to the pivot 84 of the bolt. The other end of this lever carries a transversely extending pin 92 having a portion positioned for movement within a Y-slot 94 of the bolt structure. As thus arranged, the lever 88 is constrained to limited swinging movements between the forward and rearward edges of the casing.

Provision is made for positively releasably locking the bolt 18 in its locking and non-locking positions, and for this purpose a cylindrical detent 96 is mounted for sliding movement along a slot 98 formed in the actuating lever. The detent 96 has its ends respectively positioned for movement in arcuate slots 100 respectively formed in spaced apart side walls of the casing on each side of the actuating lever 88. As shown, each of the slots 100 has dwell notches 102 and 104 at its ends. The detent is biased in an upward direction in the slot 98 by a coiled spring 106, one end of this spring being secured to an anchor pin 108 on the lever, and the other end bearing against the detent 96 so as to bias the detent into the dwell notches in the respective operative positions of the bolt 18, at which positions it will be deadlocked against movement.

Provisions is made for actuating the bolt to its operative positions in response to rotative movements of the cam arm 44 carried by the actuator shaft 32. It will be noted that the axis of rotation of the cam plate 40 is vertically aligned with the central axis of the pivot 90 of the actuating lever, but offset relatively thereto. Thus, at the dwell positions, and with detent 96 seated between transversely spaced abutment pins 110 and 112 on the lever, the cam arm 44 will first act to release the detent and thereafter shift the actuating arm from one of its locked positions to the other so as to motivate the bolt 18 from one operative position to the other.

Although not specifically shown in the drawings, a similar cam plate 40 with a cam arm 44 may be arranged on the opposite side of the casing to provide alternative means for actuating the bolt 18 from a conventional key-controlled locked cylinder having the cam plate 40 mounted thereon. However, it will be appreciated that with the locking unit of the present invention, as thus far described, the motor 56 and its friction connection to the actuator shaft 32 provides power means for actuating the bolt 18 to its respective operative positions, and the manually operable knob 54 provides manual overriding operating means which can be utilized to actuate the associated high security locking mechanism manually, when desired, independently of the motor 56. Moreover, the lock actuating unit of the present invention is so constructed that each unit with slight change of certain of the parts, as provided for, may be readily adapted for operation of right and left hand swinging door structures. For example, the base frame 20 and the lug 38 are provided with mounting openings on the opposite side of the worm 62 from that shown, for respectively receiving the ring bearings 34 and 36. At the same time, provision is made for suitably shifting the operative position of auxiliary switching means 114, which are operable by the lost motion means 76 carried by the actuator shaft 32.

Figure 4:
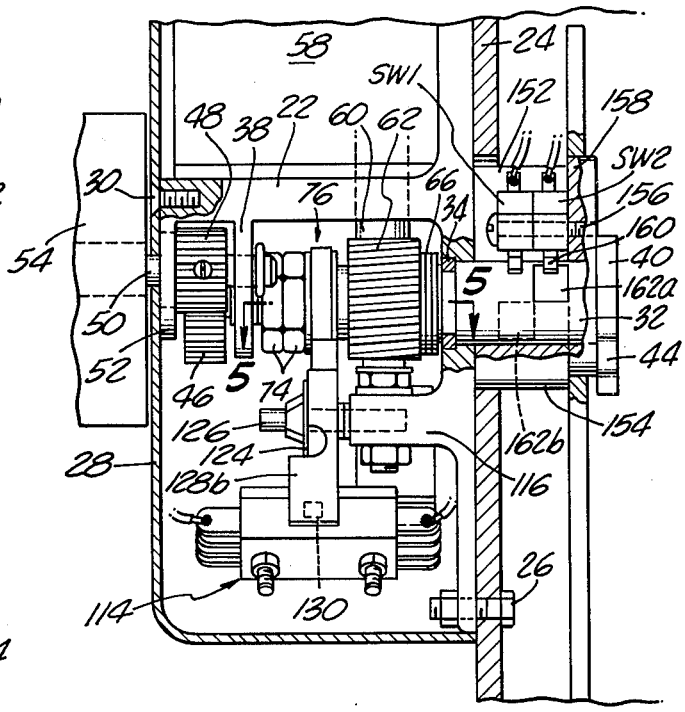
FIG. 4 is an enlarged fragmentary sectional view taken substantially on line 4—4 of FIG. 3, to show additional details of the driving connection.
Figure 3:
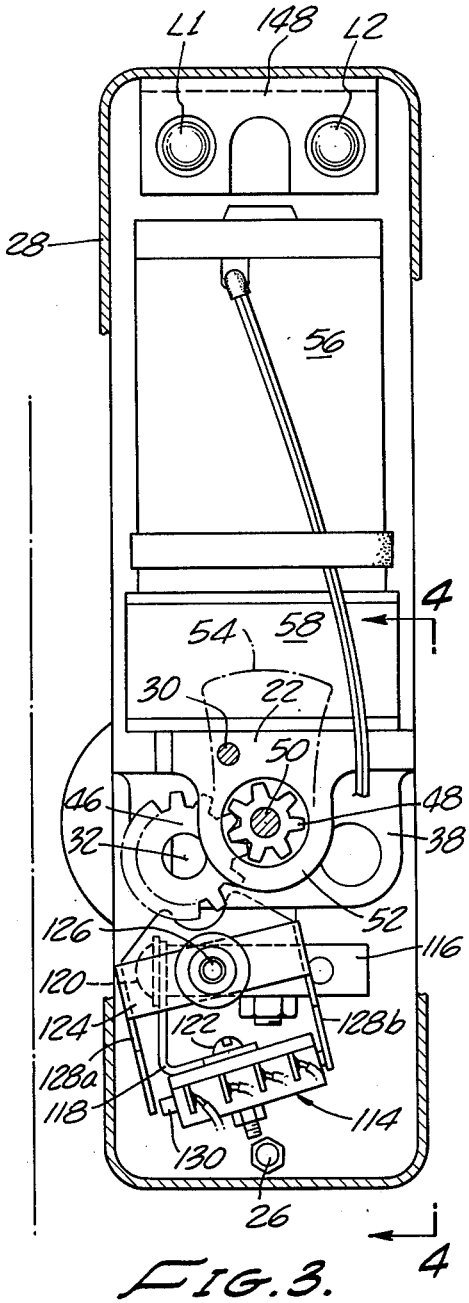
FIG. 3 is a vertical transverse sectional view of the unit, taken substantially on line 3—3 of FIG. 2.

As best shown in FIGS. 3 and 4, the base frame 20 is fabricated to provide a forwardly projecting lower platform 116 which extends below the actuator shaft 32 and normally provides a support for the lowermost end of the worm 62 on motor driving shaft 60. This platform also serves as a mount for an angular supporting bracket 118 having its uppermost end secured as by a retaining screw 120 to the platform 116 and by a retaining screw 122 at its other end to the switching means 114.

Figure 2A:
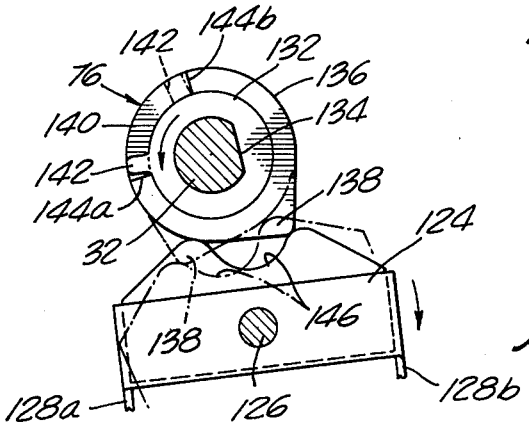
FIG. 2A is an enlarged fragmentary transverse section taken substantially on line 2A—2A of FIG. 2 for showing details of switch actuating means associated with the actuator shaft of the unit.

Provision is made for actuating the fixedly mounted switching means 114 by means of a yoke member 124 that is supported for rocking movements upon a pivot 126 having fixed support on the lower platform 116. The yoke member is positioned above the switching means 114 and has a pair of arm members **128*a* and 128*b* which are disposed upon opposite sides With the foregoing arrangement, it will be seen by reference to FIG. 2A that,if the actuator shaft 32 is moved in a counter-clockwise direction, either by operation of the motor 56, or manually by actuation of the knob 54, the projection 142 will after predetermined movement engage the abutment shoulder 144*a* and rotate the rocker cam member 136 in a clockwise direction until the lobe 138 through its coaction with the knob 146 will shift the yoke to a full line position, as shown, wherein the arm member 128*b* will engage the right end of the switch actuating plunger 130 (FIG. 3) and thus shift the switch mechanism to a position for one direction of rotation of the motor. In a similar manner, rotation of the actuator shaft 32 in a clockwise direction will carry the projectin 142 into engagement with the abutment shoulder 144*b*, as shown in phantom lines, whereupon further movement will carry the lobe 138 through the notch 146 to a position which will actuate the yoke 124 to its phantom line position for shifting the switch actuating plunger 130 in a rightward direction (FIG. 3**) so as to shift the switching means to its other reversing position.

In addition to the switching means 114, additional switches SW1 and SW2 are provided for selective operation by rotational movements of the shaft 32 for controlling a pair of indicating lamps L1 and L2 for showing the operative position of the bolt 18.

As shown in FIG. 2, the indicating lamps L1 and L2 are supported at the top of the cover member 28 by means of a lamp supporting bracket 148 which is held to the base of the switch means and adapted to respectively engage opposite ends of a switch actuating plunger 130. The switch means is so designed that movement of the actuating plunger 130 in one direction will connect the motor for one direction of rotation, while movement in an opposite direction will connect the motor for operation in an opposite direction of rotation.

Figure 5:
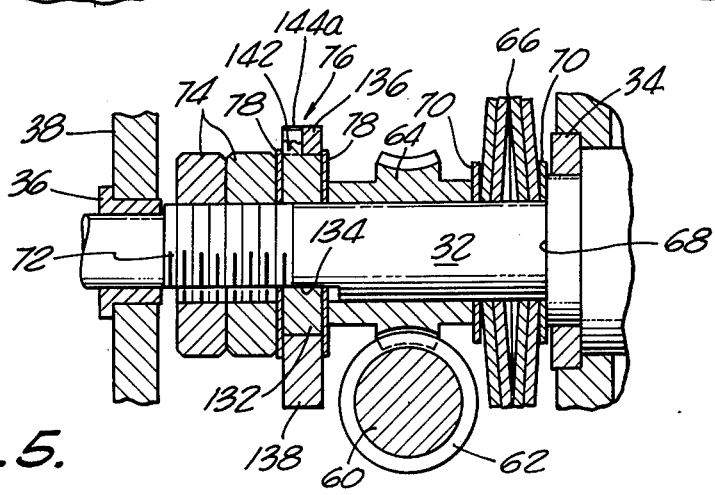
FIG. 5 is an enlarged section taken substantially on line 5—5 of FIG. 4, showing details of the actuator shaft and friction driving connection for the actuating electric motor.

As previously mentioned, the switching means is operated to its respective operating positions through the lost motion means 76, which will now be described in detail. The lost motion means may vary as to its constructional details, but in the present instance has been illustrated in FIGS. 2A and 5 as comprising an inner annular driver member 132, which is engaged with a flat surface 134 on the shaft 32 in such a manner that the driver member may be moved axially along the shaft, but will be held for rotation with the shaft. A rocker cam member 136 is rotatably supported upon the outer periphery of the driver member and is formed on one side to provide a radially projecting lobe 138, and ona generally diametrically opposite side is formed with a circumferentially extending arcuate cut-out or slot 140 within which a radial peripheral projection 142 of the driver member is adapted for relative movement between circumferentially spaced abutment shoulders **144*a* and 144*b*. Thus, a lost motion connection is established between the driver member 132 and the rocker cam member 136**.

The lobe 138, has a path of movement with reference to the yoke member 124, such that the lobe 138 will move into an upwardly opening arcuate notch 146 of the yoke member. portion 20 by the bolt 26. The bracket 148 supports the indicating lamps in viewable positions from the exterior of the cover 28 behind viewing openings 150 in each case.

Figure 8:
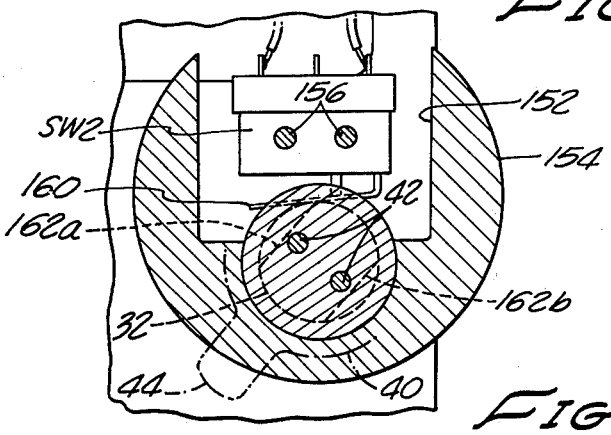
FIG. 8 is an enlarged fragmentary section taken substantially on line 8—8 of FIG. 2, showing details of selectively operable switching means for indicating the positions of the locking bolt of the locking mechanism.

As shown in FIGS. 2, 4 and 8, the switches SW1 and SW2 are supported within a cavity 152 formed in an adapter plug 154, as by a pair of spaced retaining screws 156 engaged with an inner end wall 158 of the plug. As best shown in FIG. 8, each of the swtiches SW1 and SW2 is similarly constructed for operation by actuating means including a deflectable actuator leaf member 160 which is adapted to bear against the adjacent periphery of the actuator shaft 32. As shown in FIGS. 2 and 8, the shaft 32 in this area is provided with substantially diametrically positioned chordal flat portions **162*a* and 162*b* which are axially offset for cooperation respectively with the actuator leaf members of the switches SW1 and SW2. The contacts of these switches are normally closed, so that, when the actuator leaf member is in engagement with the circular periphery of the shaft 32, the contacts will be in an open position. However, when the shaft is rotated to a position which permits the leaf to move inwardly into the chordal cut-out, the contacts will be activated to closed position and energize the associated indicating lamp to indicate an operative position of the bolt 18**.

Figure 9:
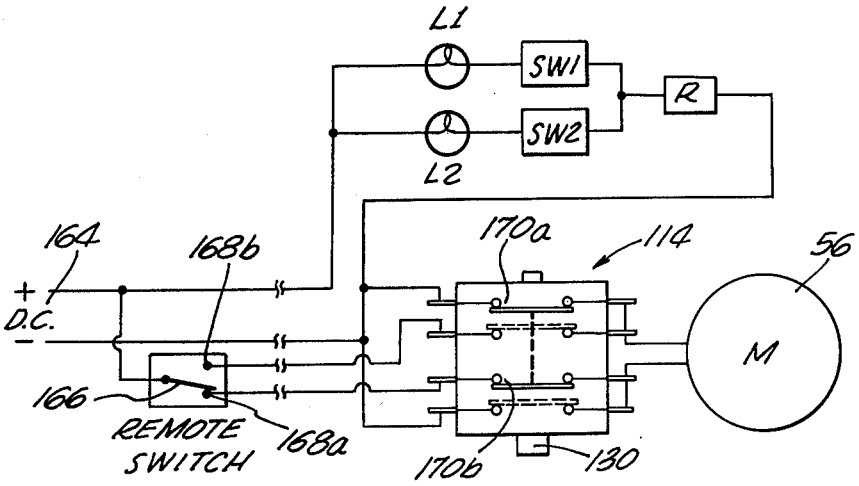
FIG. 9 is a schematic wiring diagram illustrating the control and indicating switches for the driving motor of the unit.

The control circuitry for the unit is schematically illustrated in FIG. 9, wherein the unit is connected with an electric control electrical source, as indicated by the numeral 164, of appropriate voltage. Operation of the motor 56 is arranged to be usually initiated at a remote station by means of suitable remote control, which is illustrated as comprising a remote selector switch 166. This control may comprise any one of a variety of electronic control systems, e.g., of the type employing key-coded cards, coded push-buttons, proximity switches, and the like. As shown herein, however, the switch is utilized to connect one side of the electric source selectively through the reversing switch means 114 in order to initiate operation of the motor 56 in a reversed direction of rotation from its going direction in which it has been stopped by action of the reversing switch 114. That is to say, assuming that the selector switch 166 is engaged with its contact 168*a*, the motor will operate in a going direction with the contacts 170*a* and 170*b* of the switch 114 at the positions shown in full lines. After a predetermined rotation in this direction, the lost motion means 76 will then effect movement of the switch actuating plunger 130 in a direction to move the contacts to a reversing position as shown in phantom lines in FIG. 9, whereupon the energization of the motor will be terminated, until such time as the selector switch 166 is moved to engage contact 168*b*.

Upon termination of the motor operation, the actuator shaft will be in such a position that the appropriate switch, SW1 or SW2, will close its close contacts and complete an indicating circuit including the voltage dropping resistor R which is common to the energizing circuit for both of the indicating lamps L1 and L2.

In the event that the going direction of motor operation, as explained above, has operated to move the bolt 18, for example, to a locked position, powered movement of the bolt 18 to a non-locked position is accomplished simply by moving the selector switch 166 into engagement with its contact 168*b*. This action now results in the energized operation of the motor 56 in a reversed direction to its former going direction, and will move the bolt to a non-locked position which will be indicated on the other indicating lamp. As before, after a predetermined rotation in the new reversed direction, the switch actuating plunger 130 will be operated in an opposite direction to again shift its contacts to stop the motor and connect it for the next direction of rotation.

From the foregoing description, it will be apparent that the lock mechanism as described accomplishes the stipulated objects set out for the invention.

Various modifications may suggest themselves to those skilled in the art without departing from the spirit of my invention, and, hence, I do not wish to be restricted to the specific forms shown or uses mentioned, except to the extent indicated in the appended claims.

I claim:

1. An electric power driven actuator unit for mounting on a hinged door frame in operative association with a lock mechanism having a bolt actuator supported for movements between bolt locking and bolt non-locking positions, comprising:

(a) a housing adapted to be affixed to an exposed surface of the door frame;

(b) adapter plug means carried by said housing, including a cam member adapted in the affixed position of said housing for operative association with the bolt actuator of said lock mechanism;

(c) power actuating means in said housing having a driving connection with said cam member, and being selectively energizable to rotate said cam member in directions to move the bolt actuator to locking and non-locking positions; and (d) manual actuating means having an overriding connection for moving said cam in said directions independently of said power actuating means.

2. An actuator unit according to claim 1, in which said cam is connected to a rotatable actuator shaft; said power actuating means comprises an electric motor having a friction driving connection with said shaft; and said manual actuating means are operable to rotate said shaft independently of said motor.

3. An actuator unit according to claim 2, in which said cam is connected with one end of said actuator shaft, the manual actuating means comprises a knob accessible from the housing exterior having a driving connection with the other end of said actuator shaft, and being selectively operable to move said cam in said directions; said electric motor has a drive shaft mounting a worm, said worm being operatively connected with a worm gear rotatably supported on said actuator shaft; and said friction driving connection is disposed between said gear and said actuator shaft.

4. An actuator unit according to claim 3, in which said gear is positioned on said actuator shaft between a shaft radial shoulder and an axially spaced threaded portion of said shaft; and nut means engaging said threaded portion coacts with said shoulder to apply frictional driving forces between said worm gear and said actuator shaft.

5. An actuator unit according to claim 4, in which resilient means are interposed on said shaft between said nuts and said shaft shoulder.

6. An actuator unit according to claim 5, in which the spring means comprises a series of Belleville washers positioned between said worm gear and said shaft shoulder.

7. An actuator unit according to claim 6, in which at least two of said washers have their cupped sides in confronting peripherally engaged relation.

8. An actuator unit according to claim 2, wherein said motor has an energizing circuit; and including motor control local switching means for controlling said energizing circuit in response to said actuator shaft movements.

9. An actuator unit according to claim 8, in which said local switching means are selectively operable to positions for reversing the driving direction of rotation of said motor.

10. An actuator unit according to claim 8, in which said local switching means are selectively operable to stop the motor in its going direction of rotation, and connect it for a reversed direction of rotation; and remotely located switching means operable in association with said local switching means to energize said motor for said reversed direction of rotation.

11. An actuator unit according to claim 9, in which said local switch means are actuated by a yoke member supported for rocking movements to positions respectively shifting said switch means from one of its operating positions to the other; and including connection means with the actuator shaft for shifting the yoke from one of its operating positions to the other, upon a predetermined rotational movement of said actuator shaft.

12. An actuator unit according to claim 11, in which said shaft connection means comprises a cam member supported for rotational movement on said shaft, said cam member having a radially projecting lobe portion; and in which said yoke member has a recess for receiving the end of said lobe portion in a manner such that rotation of the cam lobe in opposite directions will shift the yoke from one of its operating positions to the other; and a lost motion connection between said actuator shaft and said cam member.

13. An actuator unit according to claim 12, wherein the lost motion connection comprises a pin member rotatable with the actuator shaft, and a pair of circumferentially spaced abutment shoulders carried by said cam member positioned on opposite sides of said pin in its path of movement during shaft rotation.

14. An actuating unit according to claim 1, which includes a pair of signal lamps visible through openings in said housing for indicating the operative position of said bolt, said lamps having an energizing circuit; and switch means for controlling said energizing circuit in response to movements of said actuator shaft.

15. An actuating unit according to claim 14, in which said switch means comprises a pair of switches for respectively controlling said signal lamps, each of said switches having an actuator engaged with said actuator shaft; and circumferentially spaced flat portions on said actuator shaft for respectively engaging said switch actuators in predetermined positions of the actuator shaft in accordance with an operative position of said bolt.

* * * * *